United States Patent [19]

Knoble et al.

[11] 4,051,412

[45] Sept. 27, 1977

[54] DISCHARGE LAMP OPERATING CIRCUIT

[75] Inventors: David W. Knoble; Daniel V. Owen, both of East Flat Rock, N.C.

[73] Assignee: General Electric Company, New York, N.Y.

[21] Appl. No.: 719,765

[22] Filed: Sept. 2, 1976

[51] Int. Cl.[2] ..... H05B 41/34

[52] U.S. Cl. ..... 315/205; 315/206; 315/207; 315/208; 315/219; 315/287; 315/290; 315/DIG. 7

[58] Field of Search ..... 315/205, 206, 207, 208, 315/209 R, 219, 221, 222, 226, DIG. 7

[56] References Cited

U.S. PATENT DOCUMENTS

| | | | |
|---|---|---|---|
| 3,890,537 | 6/1975 | Park et al. | 315/208 X |
| 3,906,302 | 9/1975 | Wijsboom | 315/209 |

*Primary Examiner*—Alfred E. Smith
*Assistant Examiner*—Charles F. Roberts
*Attorney, Agent, or Firm*—Sidney Greenberg

[57] ABSTRACT

Color properties of high pressure sodium vapor discharge lamps are improved by disclosed operating circuit for applying pulsed direct current to the lamp. The circuit comprises a direct current supply circuit, a transistor switch in series with the lamp and the primary of a transformer connected across the supply circuit, a diode in series with the secondary of the transformer connected across the supply circuit, and a control circuit connected to the transistor switch for applying DC pulses to the lamp at a predetermined repetition rate and duty cycle. The circuit produces pulse waveforms which provide substantial color improvement in the lamp and makes efficient use of the energy supplied from the power source.

16 Claims, 5 Drawing Figures

DISCHARGE LAMP OPERATING CIRCUIT

Figure 1:
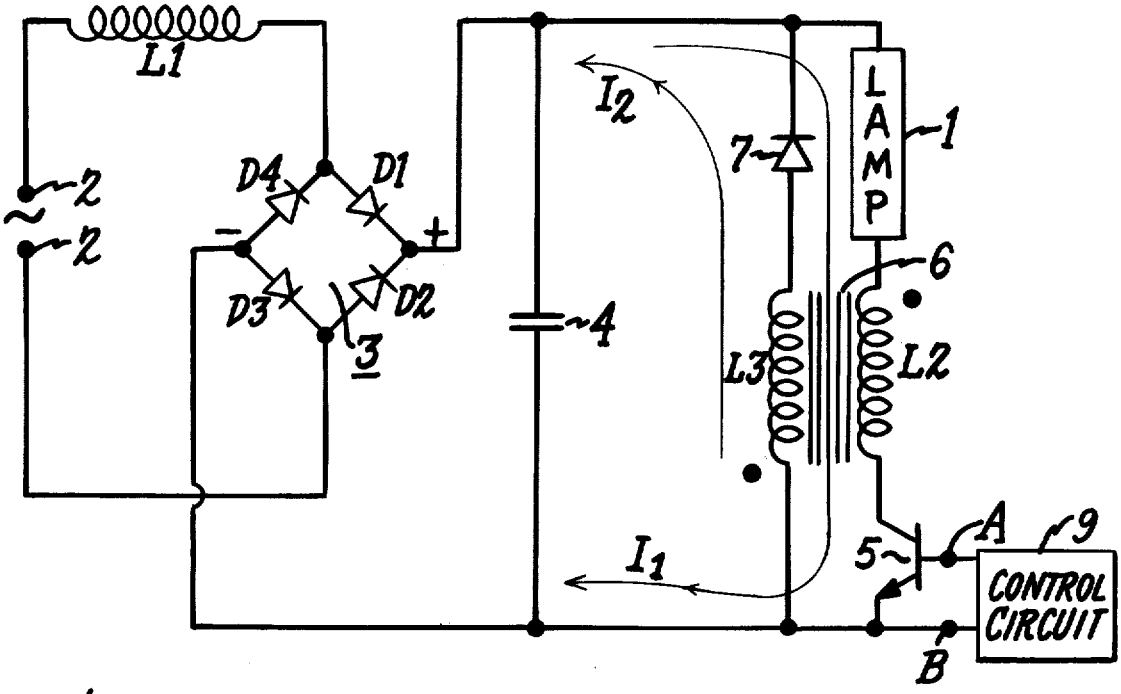

The present invention relates to discharge lamp operating circuits, and more particularly concerns direct current operating circuits for such lamps.

It is an object of the invention to provide an improved direct current operating circuit for applying direct current pulses on gaseous discharge lamps, especially of high pressure sodium vapor type, to produce improved color properties of the lamp.

It is a particular object of the invention to provide a circuit of the above type which produces current waveforms of suitable characteristics for effecting substantial increase in the color temperature of high pressure sodium vapor lamps.

Other objects and advantages will become apparent from the following description and the appended claims.

With the above objects in view, the present invention in one of its aspects relates to a lamp operating circuit comprising, in combination, a direct current power source, controlled switch means and a gaseous discharge lamp in series with the controlled switch means across the power source, unidirectional conducting means connected across the power source, a transformer having a primary winding connected in series with the controlled switch means and the lamp and a secondary winding connected in series with the unidirectional conducting means, and control means coupled to the controlled switch means for repetitively operating the same at predetermined intervals, whereby DC pulses are applied to the gaseous discharge lamp for operation thereof.

The arrangement is such that when the switch means is opened, the transformer magnetic field begins to collapse, releasing stored energy, and the secondary winding and the unidirectional conducting means, e.g., a diode, operate to conserve this energy while also providing proper lamp pulse shape by producing a reverse current back to the power supply.

The operating circuit of the invention may be used for applying DC pulses of predetermined duty cycle and repetition rate on the lamp for improving the color and other properties thereof. A method and apparatus for pulsed operation of high pressure sodium vapor lamps for improving the color rendition of such lamps are disclosed in co-pending application Ser. No. 649,900-Osteen, filed Jan. 16, 1976 and assigned to the same assignee as the present invention.

As disclosed in the Osteen application, the high pressure sodium vapor lamp typically has an elongated arc tube containing a filling of xenon at a pressure of about 30 torr as a starting gas and a charge of 25 milligrams of amalgam of 25 weight percent sodium and 75 weight percent mercury.

The present invention provides an improved circuit for DC pulsed operation of such lamps in accordance with the method and principles disclosed in the co-pending Osteen application, and the disclosure thereof in that application is accordingly incorporated herein by reference. As there disclosed, pulses may be applied to the lamp having repetition rates above 500 to about 2,000 Hertz and duty cycles from 10% to 30%. By such operation, the color temperature of the lamp is readily increased and substantial improvement in color rendition is achieved without significant loss in efficacy or reduction in lamp life.

The circuit of the present invention is also useful for operating discharge lamps containing mixed metal vapors such as the above described lamp or other lamps in a manner to avoid color separation therein, in accordance with the method and principles disclosed in co-pending application Ser. No. 701,333-Owen, filed June 30, 1976 and assigned to the same assignee as the present invention. The disclosure thereof in the said Owen application is accordingly also incorporated herein by reference.

Figure 2:
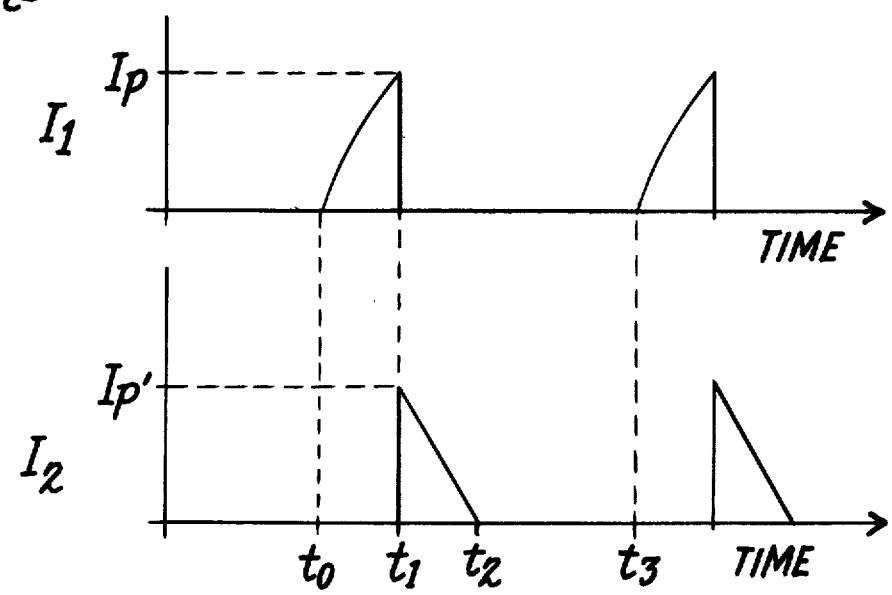
Figure 1A:
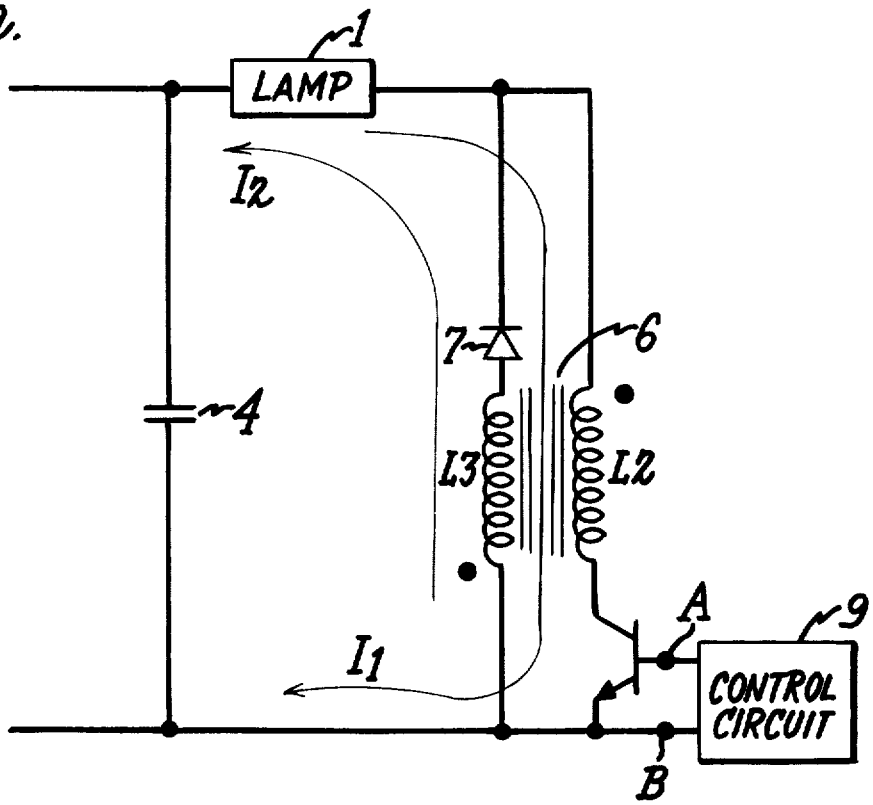
Figure 1B:
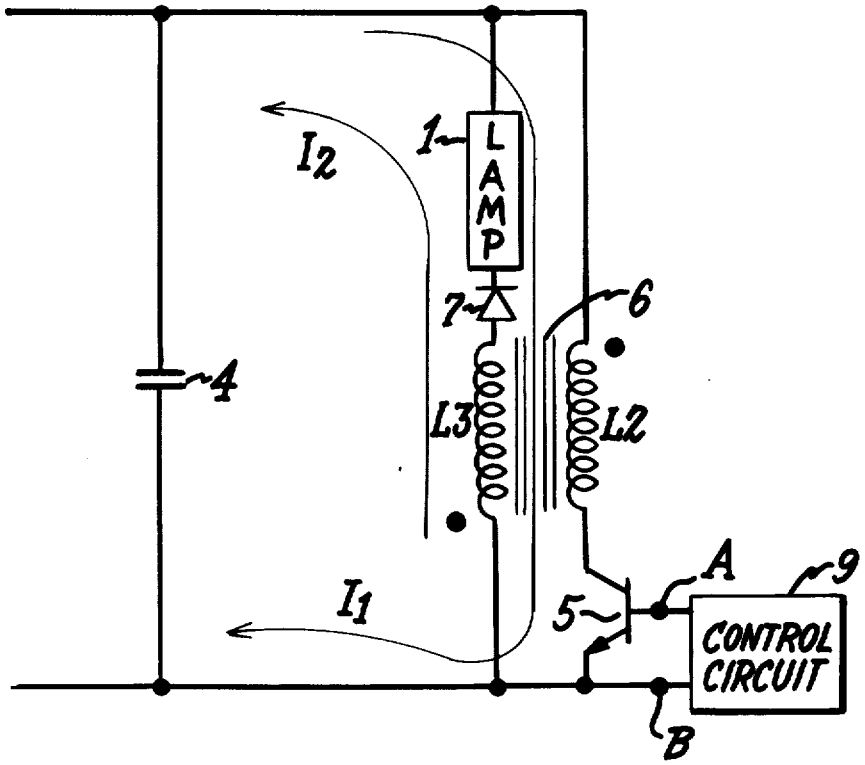
Figure 3:
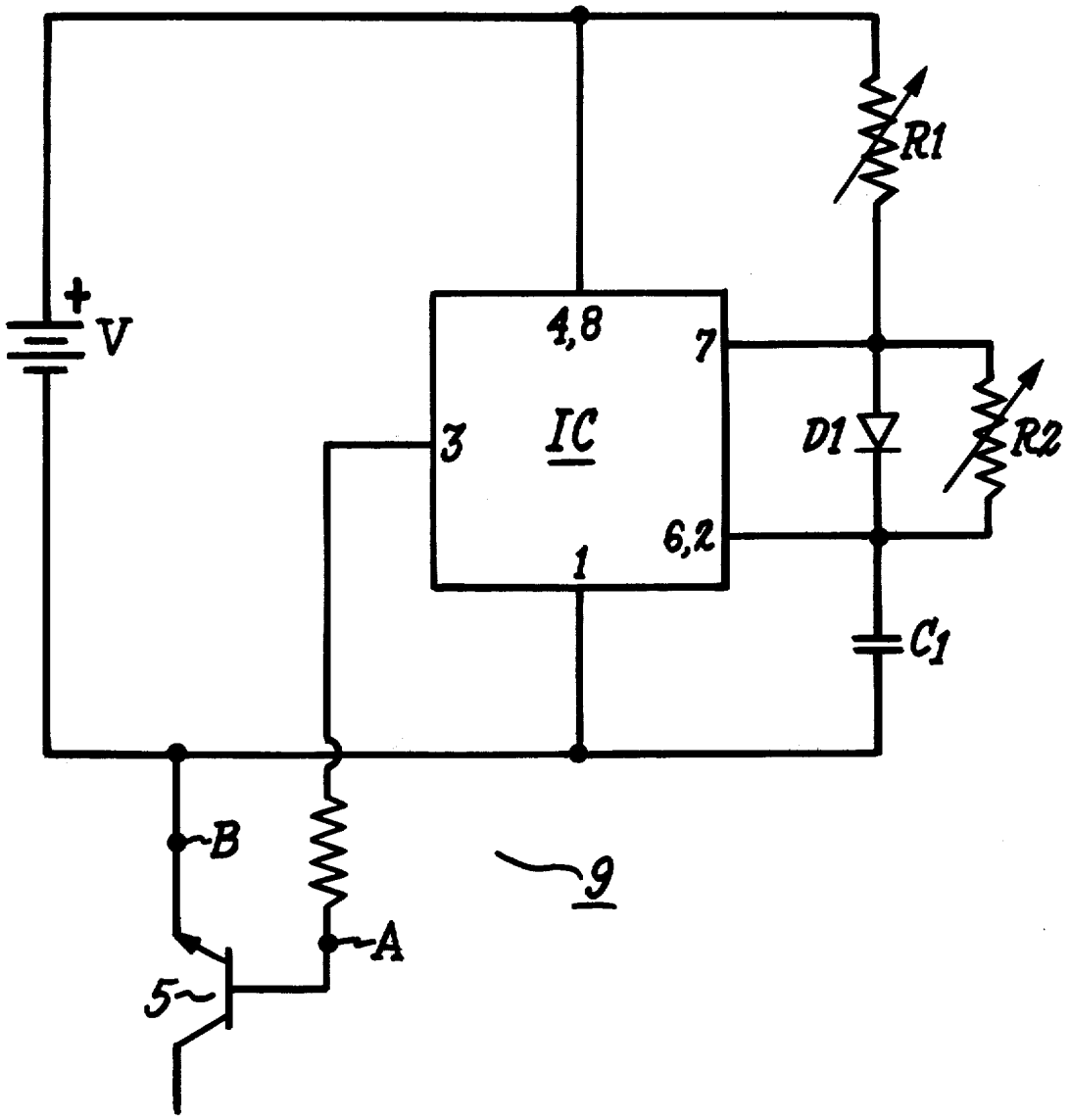

The invention will be better understood from the following description taken in conjunction with the accompanying drawings, in which:

FIG. 1 is a circuit diagram of a lamp operating circuit showing an embodiment of the invention;

FIGS. 1*a* and 1*b* show modifications of the FIG. 1 circuit;

FIG. 2 shows current waveforms relating to the operation of the FIG. 1 circuit; and FIG. 3 is a circuit diagram of the control circuit shown in FIG. 1.

Referring now to the drawings, and particularly to FIG. 1, there is shown a circuit diagram illustrating an embodiment of the DC pulsing circuit of the invention for operating a gaseous discharge lamp 1, which is typically a high pressure sodium vapor lamp such as described above. The circuit comprises terminals 2 of a source of alternating current and induction coil L1 connected at one side to one of the source terminals and at the other side to an input terminal of full wave bridge rectifier 3 which comprises diodes D1, D2, D3 and D4 arranged in conventional manner as shown, the other input terminal of rectifier 3 being connected to the other source terminal 2. Filter capacitor 4 connected across the DC supply circuit provides a filtered DC voltage supply for the pulsing circuit described hereinafter and increases the average voltage supplied thereto. Induction coil L1 serves to limit current to the lamp at the starting and warm-up stage.

The pulsing circuit illustrated in FIG. 1 comprises lamp 1 connected in series with primary winding L2 of transformer 6 and transistor 5 across the DC power supply constituted by filter capacitor 4. Diode 7 is connected in series with transformer secondary winding L3 across the power supply. As indicated in the drawing, the primary winding and the secondary winding are arranged or connected so as to be out of phase with one another.

Transistor switch 5 is operated repetitively by timing (control) circuit 9 connected to the base and emitter of transistor 5 as shown, the details of control circuit 9 being depicted in FIG. 3.

In the operation of the described circuit, and with reference to the waveform diagrams of FIG. 2, when switch 5 closed at time $t_o$, a current $I_1$ begins to flow through lamp 1 and transformer primary L2. This current increases with a time constant L/R where $L$ is the inductance of primary winding L2 and R is the effective resistance of lamp 1. At time $t_1$, switch 5 opens, thereby interrupting current flow through the lamp and winding L2. At this time, there is energy stored in the magnetic field produced by the transformer current, the amount of energy being $1/2\ LIp^2$, where Ip is the peak current through the transformer. This energy should either be stored in the circuit or dissipated in lamp 1, since to dissipate it elsewhere would decrease the efficiency of the lamp operating circuit. In accordance with the invention, this energy is stored by transferring it to the power supply, i.e., capacitor 4 in the illustrated circuit, in the manner described below.

When switch 5 opens at time $t_1$, the magnetic field in transformer 6 begins to collapse, generating a voltage on both the primary and secondary windings. This voltage is of such polarity that when the voltage on secondary winding L3 exceeds the voltage on capacitor 4, a current $I_2$ will flow. Current $I_2$ is initiated at some high value Ip' (see FIG. 2), such that $N_S Ip' = N_P Ip$, where $N_S$ and $N_P$ denote the number of turns on the secondary and primary windings respectively. Current $I_2$ decays as the energy is transferred from secondary winding L3 to capacitor 4.

When switch 5 is closed, and with current $I_2$ flowing and the polarity as shown, diode 7 is reverse biased. When switch 5 opens, current $I_1$ is interrupted, generating a voltage across windings L2 and L3, which are tightly magnetically coupled. The provision of a reverse current $I_2$ to the power supply in accordance with the invention not only contributes to producing a desirable waveform of current to the lamp as described below, but also avoids the generation of excessively high voltages in the circuit.

As a result of the described operation, the current pulses to lamp 1, as indicated by the waveform of current $I_1$ in FIG. 2, are characterized by a rapid rise and fall, which is particularly desirable in order to provide a substantial increase in color temperature of the gaseous discharge lamp, in accordance with the principles disclosed in the aforementioned Osteen application. At the same time, there is thus provided a highly efficient lamp ballast system which results in a high level of lamp system efficacy (lumens per watt).

As will be understood, the desired pulse repetition rate and duty cycle to obtain improved color properties of the lamp as disclosed in the aforementioned Osteen and Owen applications are with respect to the lamp current pulses, and control circuit 9 should accordingly be suitably adjusted to operate transistor switch 5 in such a manner as to provide the desired lamp current pulse repetition rate and duty cycle.

FIG. 3 is a circuit diagram of control circuit 9 shown in FIG. 1, wherein the control circuit has output terminal A connected to the base of transistor 5 and output terminal B connected to the emitter of the transistor. The function of control circuit 9 is to produce a base current in transistor 5 for closing that switch and to remove the base drive current to open the switch, the base drive being produced between terminals A and B. For a lamp pulse repetition rate of 1 kHz, a typical timing for operation of transistor 5 (see FIG. 2) when $t_o = 0$ would be $t_1 = 200$ microseconds.

The control circuit shown in FIG. 3 comprises a timing network consisting of a 555 type integrated circuit (IC) and associated circuitry. An example of such an integrated circuit is type NE555 available commercially from Signetics Corporation.

The pins indicated for the illustrated IC circuit have the following functions: pin 1 is the power supply common (negative) voltage, pin 2 is the trigger input, pin 3 is the output voltage, pin 4 is the reset input, pin 6 is the threshold input, pin 7 is the discharge output, and pin 8 is the positive power supply input. The IC consists of a bistable circuit whose output voltage is either high (near positive power supply voltage) or low (near common or negative power supply voltage). The circuit is triggered into the high state when the voltage at trigger pin 2 goes below 1/3 V, where V is the power supply voltage. The circuit is triggered into the low state when the voltage at the threshold pin 6 goes above 2/3 V. The discharge pin 7 exhibits a short circuit to power supply common (pin 1) when the circuit is in the low state.

The timing network associated with IC forms an astable multivibrator. It will be noted that pins 2 and 6 are both connected to timing capacitor $C_1$. Thus, when the voltage on $C_1$ goes higher than 2/3 V, threshold input pin 6 will cause the output voltage (pin 3) to go low and the discharge output (pin 7) shorts to pin 1. When the voltage on $C_1$ goes below 1/3 V, the trigger input (pin 2) will cause the output voltage to go high, and the short between the discharge output and pin 1 is removed, i.e., the discharge output is turned off. In the operation of this circuit, assuming that the voltage on capacitor $C_1$ has dropped to 1/3 V, the output voltage at pin 3 is then high, and the discharge output (pin 7) is turned off. Then $C_1$ will charge through variable resistor $R_1$ and diode $D_1$ with a time constant $R_1C_1$. When the voltage on $C_1$ reaches 2/3 V, the output voltage will go low, and pin 7 is shorted to pin 1, resulting in discharge of capacitor $C_1$ through variable resistor $R_2$ and pins 7 and 1 with a time constant $R_2C_1$. When the voltage on $C_1$ reaches 1/3 V, the cycle begins again.

The timing operation (see FIG. 2) is such that at time $t_o$, IC goes high, turning on transistor switch 5. At time $t_1$, IC goes low, turning off switch 5, thus producing a current pulse between $t_o$ and $t_1$. The cycle is repeated, beginning at time $t_3$. The time interval $t_o$ to $t_1$ is determined by the time constant $R_1C_1$ and the time interval $t_1$ to $t_3$ is determined by the time constant $R_2C_1$.

FIG. 1*a* shows a modification of the FIG. 1 circuit wherein the lamp is located in the main supply line in series between the DC supply and the junction of the described parallel branches containing the transformer primary and secondary windings, respectively. In such arrangement the pulses applied to the lamp during operation will have a waveform characterized by a composite of the waveforms for $I_1$ and $I_2$ as shown in FIG. 2.

FIG. 1*b* shows another modification of the circuit wherein the lamp is located in the secondary winding branch in series with L3 and diode 7. In this case, the waveform of the lamp current will be like that shown for $I_2$ in FIG. 2.

In a typical circuit such as shown in FIG. 1 and using a 150 watt sodium vapor lamp, inductor L1 would have an inductance of 100 millihenries, capacitor 4 would be 100 microfarads, winding L2 would be 1.3 millihenries, and the turns ratio of L3 to L2 would be 1.5 to 1.

While an independent DC voltage supply V, which may typically be about 15 volts, is shown connected to the control circuit in FIG. 3, it will be understood that, if desired, the control circuit may be connected to the DC supply of the power circuit, with the provision of suitable means for reducing the voltage.

Although a particular type of controlled switch 5 is shown and described, it will be understood that other types of controlled switches may be employed for this component.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What we claim as new and desire to secure by Letters Patent of the United States is:

1. A lamp operating circuit comprising, in combination, a direct current power source, controlled switch means across said power source, a transformer having a primary winding and a secondary winding, said primary winding in series with said controlled switch means, unidirectional conducting means in series with said secondary winding across said power source, means for connecting a gaseous discharge lamp in series with said controlled switch means and said primary winding, and control means coupled to said controlled switch means for repetitively operating the same at predetermined intervals, whereby DC pulses may be applied to the gaseous discharge lamp for operation thereof.

2. A circuit as defined in claim 1, said primary winding being connected between said controlled switch means and said lamp connecting means.

3. A circuit as defined in claim 1, said serially connected controlled switch means, lamp connecting means and primary winding forming a first branch across said power source, said serially connected unidirectional conducting means and secondary winding forming a second branch in parallel with said first branch.

4. A circuit as defined in claim 3, said unidirectional conducting means and said secondary winding being arranged such that when said controlled switch means is on, the current flows in one direction from said power source toward said first branch, and when said controlled switch means is off, the current flows in the opposite direction toward said power source from said second branch.

5. A circuit as defined in claim 1, said control means having timing network means comprising a multivibrator circuit connected to said controlled switch means.

6. A circuit as defined in claim 1, said controlled switch means comprising a transistor having a base and an emitter, said control means connected to said base and said emitter.

7. A circuit as defined in claim 4, said unidirectional conducting means comprising a diode.

8. A circuit as defined in claim 4, including a gaseous discharge lamp connected in said first branch in series with said controlled switch means and said primary winding.

9. A circuit as defined in claim 8, wherein said gaseous discharge lamp is a high pressure sodium vapor lamp.

10. A circuit as defined in claim 8, said gaseous discharge lamp comprising mixed metal vapors.

11. A circuit as defined in claim 8, said primary winding being connected between said gaseous discharge lamp and said controlled switch means.

12. A circuit as defined in claim 3, said primary winding and said secondary winding being arranged so as to be out of phase relative to one another.

13. A lamp operating circuit comprising, in combination, a direct current power source, a first branch including controlled switch means across said power source, a second branch including unidirectional conducting means across said power source, a transformer having a primary winding in said first branch in series with said controlled switch means and a secondary winding in said second branch in series with said unidirectional conducting means, means for connecting a gaseous discharge lamp to said power source in series with at least one of said branches, and control means coupled to said controlled switch means for repetitively operating the same at predetermined intervals, whereby DC pulses may be applied to the gaseous discharge lamp for operation thereof.

14. A circuit as defined in claim 13, said lamp connecting means being in said first branch in series with said controlled switch means and said primary winding.

15. A circuit as defined in claim 13, said lamp connecting means being in said second branch in series with said unidirectional conducting means and said secondary winding.

16. A circuit as defined in claim 13, said lamp connecting means being connected in series between said power source and the junction of said first and said second branches.

* * * * *